US006797116B2

(12) United States Patent
Capizzi

(10) Patent No.: US 6,797,116 B2
(45) Date of Patent: Sep. 28, 2004

(54) METHOD OF APPLYING A FOAM COMPOSITION TO A TISSUE PRODUCT

(75) Inventor: Joseph G. Capizzi, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 180 days.

(21) Appl. No.: 10/161,047

(22) Filed: May 31, 2002

(65) Prior Publication Data

US 2003/0221808 A1 Dec. 4, 2003

(51) Int. Cl.[7] ..... D21F 13/00

(52) U.S. Cl. ..... 162/135; 162/184; 162/146; 162/186; 162/109; 162/111; 162/112; 162/123; 427/243; 427/244; 427/194; 427/296; 118/257

(58) Field of Search ..... 162/135, 184, 162/146, 186, 109, 111, 112, 113, 123; 118/257; 427/243, 244, 294, 296, 373, 391, 428

(56) References Cited

U.S. PATENT DOCUMENTS

| | | | | |
|---|---|---|---|---|
| 3,722,469 A | | 3/1973 | Bartley et al. | |
| 3,865,078 A | | 2/1975 | De Howitt et al. | |
| 3,905,329 A | | 9/1975 | Cone et al. | |
| 3,930,465 A | | 1/1976 | Schuierer | |
| 4,005,028 A | | 1/1977 | Heckert et al. | |
| 4,005,030 A | | 1/1977 | Heckert et al. | |
| 4,016,831 A | | 4/1977 | James et al. | |
| 4,023,526 A | | 5/1977 | Ashmus et al. | |
| 4,061,001 A | | 12/1977 | Von Der Eltz et al. | |
| 4,081,318 A | * | 3/1978 | Wietsma | 162/157.3 |
| 4,089,296 A | | 5/1978 | Barchi | |
| 4,099,913 A | | 7/1978 | Walter et al. | |
| 4,118,526 A | | 10/1978 | Gregorian et al. | |
| 4,158,076 A | | 6/1979 | Wallsten | |
| 4,159,355 A | | 6/1979 | Kaufman | |
| 4,184,914 A | | 1/1980 | Jenkins | |
| 4,193,762 A | | 3/1980 | Namboodri | |
| 4,198,316 A | | 4/1980 | Nahta | |
| 4,230,746 A | | 10/1980 | Nahta | |
| 4,237,818 A | | 12/1980 | Clifford et al. | |
| 4,263,344 A | | 4/1981 | Radvan et al. | |
| 4,276,339 A | | 6/1981 | Stoveken | |
| 4,279,964 A | | 7/1981 | Heller | |
| 4,288,475 A | | 9/1981 | Meeker | |

(List continued on next page.)

FOREIGN PATENT DOCUMENTS

| | | |
|---|---|---|
| DE | 252208 | 10/1911 |
| EP | 0047908 | 3/1982 |
| EP | 0098362 | 1/1984 |
| EP | 0120472 | 10/1984 |

(List continued on next page.)

OTHER PUBLICATIONS

U.S. patent application Ser. No. 10/007,627, Capizzi, filed Nov. 8, 2002, Foam Treatment of Tissue Products.

U.S. patent application Ser. No. 10/161,048, Capizzi, filed May 31, 2002, Application of Foam to Tissue Products Using a Liquid Permeable Partition.

U.S. patent application Ser. No. 10/161,049, Capizzi, filed May 31, 2002, Use of Gaseous Streams to Aid in Application of Foam to Tissue Products.

PCT Search Report, Jun. 20, 2003.

*Primary Examiner*—Peter Chin
*Assistant Examiner*—Mark Halpern
(74) *Attorney, Agent, or Firm*—Dority & Manning, P.A.

(57) ABSTRACT

A method for applying a foam composition to a paper web is provided. Specifically, a paper web is initially formed from papermaking fibers and is carried by a first moving papermaking surface so that a first surface of the paper web faces the first moving papermaking surface (e.g., fabric). A foam composition is deposited onto a second moving papermaking surface (e.g., fabric). The second moving papermaking surface is positioned adjacent to the first moving papermaking surface so that a second surface of the paper web faces the second moving papermaking surface. As a result, at least a portion of the foam composition is transferred to the paper web.

32 Claims, 3 Drawing Sheets

U.S. PATENT DOCUMENTS 4,297,860 A 11/1981 Pacifici et al.
4,305,169 A 12/1981 Vidalis
4,343,835 A 8/1982 Jones et al.
4,348,251 A 9/1982 Pauls et al.
4,364,784 A 12/1982 Van Wersch et al.
4,366,682 A 1/1983 Keller
4,384,867 A 5/1983 Grüber
4,385,954 A 5/1983 Pauls et al.
4,387,118 A 6/1983 Shelton
4,400,953 A 8/1983 Driessen et al.
4,402,200 A 9/1983 Clifford et al.
4,435,965 A 3/1984 Sasseville et al.
4,440,808 A 4/1984 Mitter
4,442,771 A 4/1984 Mitter
4,444,104 A 4/1984 Mitter
4,453,462 A 6/1984 Mitter
4,463,467 A 8/1984 Grüber et al.
4,463,583 A 8/1984 Krüger et al.
4,474,110 A 10/1984 Rosner
4,497,273 A 2/1985 Mitter
4,498,318 A 2/1985 Mitter
4,501,038 A 2/1985 Otting
4,502,304 A 3/1985 Hopkins
4,534,189 A 8/1985 Clifford
4,549,915 A 10/1985 Ritschel et al.
4,552,778 A 11/1985 Zimmer
4,557,218 A 12/1985 Sievers
4,559,243 A 12/1985 Pässler et al.
4,562,097 A 12/1985 Walter et al.
4,571,360 A 2/1986 Brown et al.
4,576,112 A 3/1986 Funger et al.
4,581,254 A 4/1986 Cunningham et al.
4,597,831 A 7/1986 Anderson
4,606,944 A 8/1986 Lauchenauer
4,612,874 A 9/1986 Mitter
4,646,675 A 3/1987 Arthur et al.
4,655,056 A 4/1987 Zeiffer
4,665,723 A 5/1987 Zimmer
4,667,882 A 5/1987 Pacifici
4,731,092 A 3/1988 Berendt
4,734,100 A 3/1988 Berendt et al.
4,741,739 A 5/1988 Berendt et al.
4,762,727 A 8/1988 Voswinckel
4,773,110 A 9/1988 Hopkins
4,778,477 A 10/1988 Lauchenauer
4,792,619 A 12/1988 Berendt et al.
4,799,278 A 1/1989 Beeh
4,833,748 A 5/1989 Zimmer et al.
4,872,325 A 10/1989 Moser et al.
4,894,118 A 1/1990 Edwards et al.
4,912,948 A 4/1990 Brown et al.
5,008,131 A 4/1991 Bakhshi
5,009,932 A 4/1991 Klett et al.
5,048,589 A 9/1991 Cook et al.
5,089,296 A 2/1992 Bafford et al.
5,145,527 A 9/1992 Clifford et al.
5,165,261 A 11/1992 Cho
5,219,620 A 6/1993 Potter et al.
5,227,023 A 7/1993 Pounder et al.
5,328,685 A 7/1994 Janchiraponvej et al.
5,340,609 A 8/1994 Arthur et al.
5,366,161 A 11/1994 Potter et al.
5,399,412 A 3/1995 Sudall et al.
5,429,840 A 7/1995 Raterman et al.
5,492,655 A 2/1996 Morton et al.
5,505,997 A 4/1996 Strong et al.
5,510,001 A 4/1996 Hermans et al.
5,524,828 A 6/1996 Raterman et al.
5,552,020 A 9/1996 Smith et al.
5,591,309 A 1/1997 Rugowski et al.
5,605,719 A 2/1997 Tench et al.
5,635,469 A 6/1997 Fowler et al.
5,667,636 A 9/1997 Engel et al.
5,783,043 A * 7/1998 Christensen ..... 162/265
5,792,737 A 8/1998 Grüning et al.
5,795,386 A * 8/1998 Foster et al. ..... 118/203
5,830,483 A 11/1998 Seidel et al.
5,840,403 A 11/1998 Trokhan et al.
5,857,627 A 1/1999 Horwell et al.
5,861,143 A 1/1999 Peterson et al.
5,869,075 A 2/1999 Krzysik
5,904,809 A 5/1999 Rokman et al.
5,985,434 A 11/1999 Qin et al.
6,017,417 A 1/2000 Wendt et al.
6,103,128 A 8/2000 Koso et al.
6,132,803 A 10/2000 Kelly et al.
6,238,518 B1 5/2001 Rokman et al.
6,241,220 B1 6/2001 Blackwell et al.
6,511,579 B1 1/2003 Edwards et al.
6,582,555 B2 * 6/2003 Capizzi et al. ..... 162/112
6,612,468 B2 9/2003 Pritchett et al.

FOREIGN PATENT DOCUMENTS

EP 0195458 A1 9/1986
EP 0196576 4/1989
EP 0336439 10/1989
EP 1149947 10/2001
GB 1585874 3/1981
WO WO 9840207 A1 9/1998
WO WO 9913158 3/1999
WO WO 9919081 4/1999
WO WO 0015907 A1 3/2000
WO WO 0216689 A3 2/2002
WO WO 0216689 A2 2/2002
WO WO 0238865 A2 5/2002
WO WO 0238865 A3 6/2002

* cited by examiner

METHOD OF APPLYING A FOAM COMPOSITION TO A TISSUE PRODUCT

BACKGROUND OF THE INVENTION

Consumers use tissue products for a wide variety of applications. For example, various types of tissue products may be used, such as facial tissues, bath tissues, paper towels, napkins, wipes, etc. In many instances, various types of liquid-based compositions, such as softening compositions, lotions, friction reducing agents, adhesives, strength agents, etc., are also applied to one or paper webs of the tissue product. For example, a paper web is often softened through the application of a chemical additive (i.e., softener). However, one problem associated with some liquid-based compositions is the relative difficulty in uniformly applying the composition to the paper web of the tissue product. Moreover, many application methods are relatively inefficient and thus may result in substantial waste of the composition being applied.

For instance, many softeners are made as an emulsion containing a particular solids content in solution. However, such liquid-based compositions are often difficult to adequately apply to a paper web. In particular, when applying such a liquid-based composition, the paper web can become undesirably saturated, thereby requiring the paper web to be dried. Moreover, it is also difficult to uniformly spread the liquid-based composition on a paper web in such a manner to provide adequate surface area coverage. In addition, some softeners contain components that cause the liquid-based composition to be formed as a solid or semi-solid. To facilitate application of these liquid-based compositions onto a tissue product, extensive heating may be required. Moreover, even after extensive heating, it may nevertheless be difficult to uniformly apply the composition to the tissue surface.

As such, a need currently exists for an improved method of applying a liquid-based composition to a paper web.

SUMMARY OF THE INVENTION

In accordance with one embodiment of the present invention, a method of applying a foam composition to a paper web having a first surface and an opposing second surface is disclosed. The method comprises forming a paper web from papermaking fibers. The paper web is carried by a first moving papermaking surface (e.g., fabric, wire-mesh surface) so that the first surface of the paper web faces said first moving papermaking surface.

The method also comprises depositing the foam composition onto a second moving papermaking surface (e.g., fabric, wire-mesh surface, etc.). The second moving papermaking surface is positioned adjacent to the first moving papermaking surface so that the second surface of the paper web faces the second moving papermaking surface. As a result, at least a portion of the foam composition is transferred to the paper web.

In one embodiment, the first moving papermaking surface and the second moving papermaking surface can be wrapped around a roll. When wrapped in this manner, the papermaking surfaces can be impressed against the roll to facilitate transfer of the foam composition to the paper web. In some embodiments, the angle of the wrap is from about 90° to about 180°, and in some embodiments, from about 100° to about 150°. Moreover, if desired, the first moving papermaking surface and the second moving papermaking surface can converge at a nip. In some embodiments, for example, the foam composition is applied to the second moving papermaking surface using a foam applicator that is positioned less than about 200 inches, in some embodiments less than about 100 inches, and in some embodiments from about 5 inches to about 60 inches from the nip.

Other features and aspects of the present invention are described in more detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
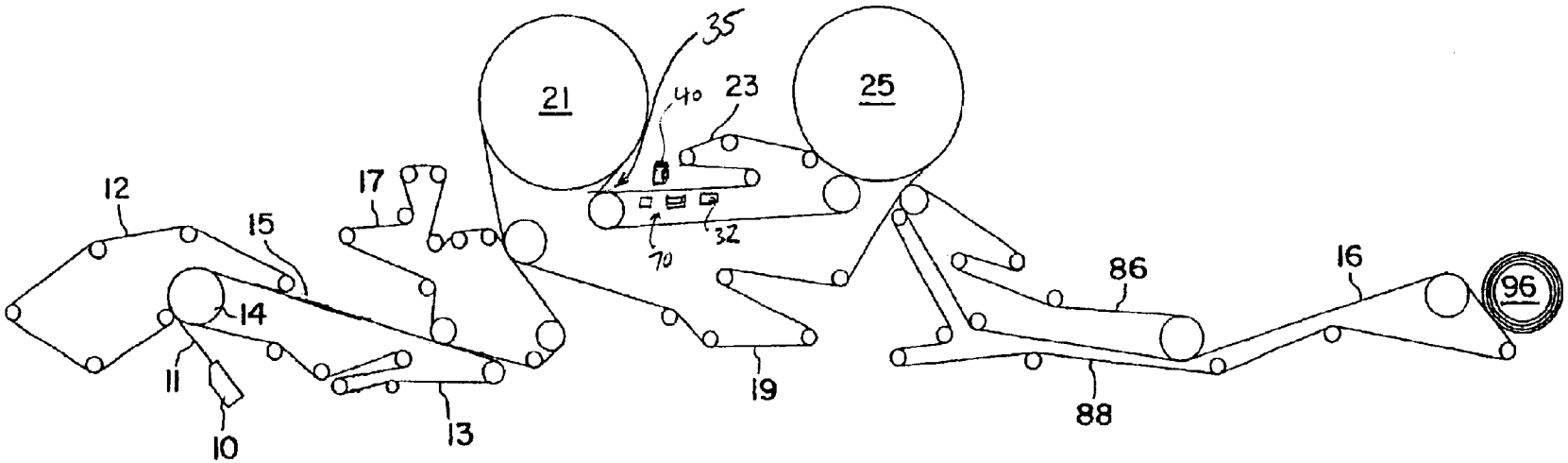
FIG. 1 is a schematic illustration of one embodiment of the present invention for forming a paper web.

Repeat use of reference characters in the present specification and drawings is intended to represent same or analogous features or elements of the present invention.

DETAILED DESCRIPTION OF REPRESENTATIVE EMBODIMENTS

Definitions

As used herein, the terms "foam" or "foam composition" generally refer to a porous matrix that is an aggregate of hollow cells or bubbles, the walls of which contain liquid material. The cells may be interconnected to form channels or capillaries within the foam structure wherein such channels or capillaries facilitate liquid distribution within the foam.

As used herein, the terms "liquid composition" or "liquid-based composition" generally refer to any composition that is capable of existing in a liquid state. In particular, a liquid-based composition may exist naturally in a liquid state, or may require liquid-enhancing aids, such as heating or cooling, foaming aids (e.g., surfactants), viscosity modifiers, etc., to achieve such a liquid state. Moreover, a "liquid-based" composition can also include emulsions having a certain solids content. Some examples of liquid-based compositions that may be applied to a paper web may include, but are not limited to, softening agents, wet-strength agents, binders, adhesives, friction-reducing agents, and other compositions often applied during a papermaking process.

Other materials may also be utilized in conjunction with the liquid-based composition. For example, a variety of foaming aids may be applied to the liquid-based composition. Foaming aids may be useful in facilitating the generation of foam. A foaming aid may also be useful in stabilizing existing foam. In general, any of a variety of foaming aids may be applied to the liquid-based composition. In particular, foaming aids that have a low critical miscelle concentration, are cationic and/or amphoteric, and have small bubble sizes are typically utilized. Some examples of suitable foaming aids include, but are not limited to, fatty acid amines, amides, and/or amine oxides; fatty acid quaternary compounds; electrolytes (to help achieve foam stability); and the like. Some commercially available foaming aids that are suitable in the present invention are Mackernium 516, Mackam 2C, and Mackam CBS-50G made by McIntyre Group, Ltd. When utilized, the foaming aids are generally incorporated into the liquid-based composition in amounts up to about 50% by weight of the liquid-based composition, in some embodiments from about 0.1 to about 20% by weight of the liquid-based composition, and in some embodiments, from about 2% by weight to about 5% by weight. Other suitable foaming aids are described in U.S. Pat. No. 4,581,254 issued to Cunningham, et al., which is incorporated herein in its entirety by reference thereto for all purposes (hereinafter referred to as the "Cunningham et al. reference").

Still other examples of suitable materials that may be added to a liquid-based composition are disclosed in U.S. Pat. No. 5,869,075 issued to Krzysik, which is incorporated herein in its entirety by reference for all purposes. For instance, some of such materials include, but are not limited to: anti-microbial agents; odor absorbers; masking fragrances; antiseptic actives; anti-oxidants; astringents—cosmetic (induce a tightening or tingling sensation on skin); astringent—drug (a drug product which checks oozing, discharge, or bleeding when applied to skin or mucous membrane and works by coagulating protein); biological additives (enhance the performance or consumer appeal of the product); colorants (impart color to the product); emollients (help to maintain the soft, smooth, and pliable appearance of the skin by their ability to remain on the skin surface or in the stratum corneum to act as lubricants, to reduce flaking, and to improve the skin's appearance); external analgesics (a topically applied drug that has a topical analgesic, anesthetic, or antipruritic effect by depressing cutaneous sensory receptors, of that has a topical counter-irritant effect by stimulating cutaneous sensory receptors); film formers (to hold active ingredients on the skin by producing a continuous film on skin upon drying); humectants (increase the water content of the top layers of the skin); natural moisturizing agents (NMF) and other skin moisturizing ingredients known in the art; opacifiers (reduce the clarity or transparent appearance of the product); skin conditioning agents; skin exfoliating agents (ingredients that increase the rate of skin cell turnover such as alpha hydroxy acids and beta hydroxyacids); skin protectants (a drug product which protects injured or exposed skin or mucous membrane surface from harmful or annoying stimuli); and the like.

As used herein, a "tissue product" generally refers to various paper-based products, such as facial tissue, bath tissue, paper towels, napkins, and the like. Normally, the basis weight of a tissue product of the present invention is less than about 120 grams per square meter (gsm), in some embodiments less than about 80 grams per square meter, and in some embodiments, from about 10 to about 60 gsm.

DETAILED DESCRIPTION

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents.

In general, the present invention is directed to a method for applying a liquid-based composition to a paper web of a tissue product. In particular, the method of the present invention involves depositing the liquid-based composition as a foam onto a papermaking surface (e.g., foraminous surface, such as fabric, wire-mesh, etc.). After application, the foam is transferred to the paper web (wet or dried), which is carried on another papermaking surface. It has been discovered that by depositing the foam onto a papermaking surface and then transferring it to the paper web, a more uniform application can be achieved.

Any type of tissue construction carte applied with a foam composition in accordance with the present invention. For example, the tissue product can be a single-ply tissue product in which the paper web forming the tissue is has one layer or is stratified, i.e., has multiple layers, or a multi-ply tissue product in which the paper webs forming the multi-ply tissue product may themselves be either single or multi-layered. However, it should be understood that the tissue product can include any number of plies or layers and can be made from various types of fibers.

The material(s) used to make the paper web can include fibers formed by a variety of pulping processes, such as kraft pulp, sulfite pulp, thermomechanical pulp, etc. The pulp fibers may include softwood fibers having an average fiber length of greater than 1 mm and particularly from about 2 to 5 mm based on a length-weighted average. Such softwood fibers can include, but are not limited to, northern softwood, southern softwood, redwood, red cedar, hemlock, pine (e.g., southern pines), spruce (e.g., black spruce), combinations thereof, and the like. Exemplary commercially available pulp fibers suitable for the present invention include those available from Kimberly-Clark Corporation under the trade designations "Longlac-19".

Hardwood fibers, such as eucalyptus, maple, birch, aspen, and the like, can also be used. In certain instances, eucalyptus fibers may be particularly desired to increase the softness of the web. Eucalyptus fibers can also enhance the brightness, increase the opacity, and change the pore structure of the web to increase its wicking ability. Moreover, if desired, secondary fibers obtained from recycled materials may be used, such as fiber pulp from sources such as, for example, newsprint, reclaimed paperboard, and office waste. Further, other natural fibers can also be used in the present invention, such as abaca, sabai grass, milkweed floss, pineapple leaf, and the like. In addition, in some instances, synthetic fibers can also be utilized. Some suitable synthetic fibers can include, but are not limited to, rayon fibers, ethylene vinyl alcohol copolymer fibers, polyolefin fibers, polyesters, and the like.

The paper web can generally be formed by any of a variety of papermaking processes known in the art. In particular, it should be understood that the present invention is not limited to any particular papermaking process. In fact, any process capable of producing a paper web can be utilized in the present invention. For example, a papermaking process of the present invention can utilize creping, embossing, wet-pressing, through-drying, through-dry creping, uncreped through-drying, double creping, calendering, as well as other steps and/or papermaking devices (e.g., Yankee dryers) in producing the paper web.

In one particular embodiment, the paper web is formed by a technique known as "uncreped through-drying." Uncreped through-drying generally involves the steps of: (1) forming a furnish of cellulosic fibers, water, and optionally, other additives; (2) depositing the furnish on a moving papermaking surface (e.g., belt, fabric, wire, etc.), thereby forming a paper web on top of the moving papermaking surface; (3) subjecting the paper web to through-drying to remove the water from the paper web; and (4) removing the dried paper web from the moving papermaking surface. Examples of such a technique are disclosed in U.S. Pat. Nos. 5,048,589 issued to Cook, et al.; 5,399,412 issued to Sudall, et al.; 5,510,001 issued to Hermans, et al.; 5,591,309 issued to Rugowski, et al.; and, 6,017,417 issued to Wendt, et al., which are incorporated herein in their entirety by reference thereto for all purposes. The U.S. Pat. No. 6,017,417 is hereinafter referred to at the "Wendt et al. reference".

In this regard, one embodiment of an uncreped through-drying papermaking process that can be used in the present invention is illustrated in FIG. 1. For simplicity, the various tensioning rolls schematically used to define the several fabric runs are shown but not numbered. As shown, a papermaking headbox 10 is used to inject or deposit a stream 11 of an aqueous suspension of fibers onto the forming fabric 12. The headbox 10 may be any papermaking headbox used in the art, such as a stratified headbox capable of producing a multilayered paper web. For example, it may be desirable to provide relatively short or straight fibers in one layer of the paper web to give a layer with high capillary pressure, while another layer contains relatively longer, bulkier, or more curled fibers for high permeability and high absorbent capacity and high pore volume. It may also be desirable to apply different chemical agents to separate layers of the paper web to optimize dry and wet strength, pore space, wetting angle, appearance, or other properties of a paper web. Further, multiple headboxes may be used to create a layered structure, as is known in the art.

As shown, the stream 11 is then transferred with the aid of a roll 14 from the forming fabric 12 to a drainage fabric 13, which serves to support and carry the newly-formed wet paper web 15 downstream in the process as the wet paper web 15 is partially dewatered to a solids consistency of about 10% by dry weight of the wet paper web 15. In some instances, additional dewatering of the wet paper web 15 may be carried out, such as by a vacuum slot, while the wet paper web 15 is supported by the drainage fabric 13.

The wet paper web 15 is then transferred from the drainage fabric 13 to a transfer fabric 17 that may travel at a slower speed than the drainage fabric 13 in order to impart increased stretch into the wet paper web 15. This is commonly referred to as "rush" transfer. One useful method of performing rush transfer is taught in U.S. Pat. No. 5,667,636 issued to Engel et al., which is incorporated herein in its entirety by reference thereto for all purposes. The relative speed difference between the drainage fabric 13 and the transfer fabric 17 may be from 0% to about 80%, in some embodiments from about 10% to about 60%, and in some embodiments, from about 10% to about 40%. The transfer may be carried out with the assistance of a vacuum shoe or roll such that the drainage fabric 13 and the transfer fabric 17 simultaneously converge and diverge at the leading edge of the vacuum slot of the vacuum shoe or roll.

Thereafter, the wet paper web 15 is transferred from the transfer fabric 17 to a through-drying fabric 19 with the aid of a vacuum transfer roll or shoe. The through-drying fabric 19 may be traveling at about the same speed or a different speed relative to the transfer fabric 17. For example, if desired, the through-drying fabric 19 may run at a slower speed to further enhance stretch. The vacuum transfer roll or shoe (negative pressure) may be supplemented or replaced by the use of positive pressure from the opposite side of the wet paper web 15 to blow the wet paper web 15 onto the next fabric.

In some embodiments, the through-drying fabric 19 may be a smoother fabric, such as Asten 934, 937, 939, 959 or Albany 94M. However, in other embodiments, it may be desired to form elevated regions and depressions into the wet paper web 15. To impart such elevated regions, in one embodiment, the through-drying fabric 19 may be a fabric having impression knuckles, such as described in the Wendt et al. reference. For example, when imprinted with elevations, the resulting paper web can have from about 5 to about 300 protrusions per square inch. Moreover, the protrusions can have a height relative to the plane of the basesheet, as measured in the uncalendered state and uncreped state, of greater than about 0.1 mm, particularly greater than about 0.2 mm, more particularly greater than about 0.3 mm, and in most embodiments, from about 0.25 mm to about 0.6 mm.

Thereafter, a through-dryer 21 may accomplish the removal of moisture from the wet paper web 15 by passing air through the wet paper web 15 without applying any mechanical pressure. The through-drying process may also increase the bulk and softness of the wet paper web 15. In one embodiment, for example, the through-dryer 21 may contain a rotatable, perforated cylinder and a hood (not shown) for receiving hot air blown through perforations of the cylinder as through-drying fabric 19 carries the wet paper web 15 over the upper portion of the cylinder. The heated air is forced through the perforations in the cylinder of the through-dryer 21 and removes the remaining water from the wet paper web 15. The temperature of the air forced through the wet paper web 15 by the through-dryer 21 may vary, but is typically from about 300° F. to about 400° F.

While supported by the through-drying fabric 19, the wet paper web 15 may then be partially dried by the through-dryer 21, such as, for example, to a solids consistency of less than about 95% by dry weight of the wet paper web 15, in some embodiments to a solids consistency of from about 60% to about 95% by dry weight of the wet paper web 15, and in some embodiments, to a solids consistency of from about 80% to about 90% by dry weight of the wet paper web 15.

After being dried by the through-dryer, the wet paper web 15 is then sandwiched between the through-drying fabric 19 and the fabric 23 to further dewater the wet paper web 15. In some instances, another through-dryer 25 may substantially dry the wet paper web 15 by passing air therethrough without applying any mechanical pressure. For example, in some embodiments, the wet paper web 15 may be dried to a consistency of about 95% or greater by the through-dryer 21, thereby forming a dried paper web 16. The dried paper web 16 may be carried on additional fabrics, such as transfer fabrics 86 and 88 as shown in FIG. 1. The dried paper web 16 may then be transferred to a winding reel 96, or to various off-line processing stations, such as subsequent off-line calendering to improve the smoothness and softness of the dried paper web 16.

As stated above, a foam composition can be applied to the paper web. The foam composition may be formed according to any foam-forming technique known in the art. For instance, in one embodiment, a liquid-based composition may be metered to a foaming system where it may be combined with a gas, such as compressed air, in various proportions. For example, to ensure that the resulting foam is generally stable, the ratio of air volume to liquid volume in the foam (i.e., blow ratio) may be greater than about 3:1, in some embodiments from about 5:1 to about 180:1, in some embodiments from about 10:1 to about 100:1, and in some embodiments, from about 20:1 to about 60:1. For instance, in one embodiment, a blow ratio of about 30:1 may be obtained from a liquid flow rate of 113 cubic centimeters per minute and an air flow rate of 3400 cubic centimeters per minute. In another embodiment, a blow ratio of about 20:1 may be obtained from a liquid flow rate of 240 cubic centimeters per minute and an air flow rate of 4800 cubic centimeters per minute.

Within the foaming system, a foam generator may combine the air and the liquid-based composition at a certain energy so that a foam may form. In one embodiment, for example, the foam generator rotates at a certain speed so as to cause the liquid-based composition to pass through a series of edges, which allow trailing eddy currents of air to entrain into the liquid-based composition. In particular, the foam generator may operate at speeds from about 300 revolutions per minute (rpm) to about 700 rpm, and more particularly from about 400 rpm to about 600 rpm. For example, suitable foam generators are described in U.S. Pat. No. 4,237,818 issued to Clifford et al., which is incorporated herein in its entirety by reference thereto for all purposes (hereinafter referred to at the "Clifford et al. reference"). Moreover, one commercially available foam generator that may be utilized in the present invention may be obtained from Gaston Systems, located in Stanley, N.C.

The characteristics of the resulting foam may vary, depending on the parameters of the foam generator utilized, the ratio of the volume of gas to the volume of the liquid-based composition, etc. For instance, in some embodiments, the foam may have a "half-life" that allows the foam to travel from the foam generator to an applicator before collapsing. In some embodiments, a foam bubble may have a half-life of greater than about 1 minute, in some embodiments greater than about 3 minutes, more specifically, from about 3 minutes to about 30 minutes, and most specifically, from about 15 minutes to about 25 minutes.

The half-life of the foam may generally be determined in the following manner. A calibrated beaker is positioned on a scale and placed under a 500 cubic centimeter separator funnel. Approximately 50 grams of a foam sample is then collected into the separator funnel. As soon as all of the foam is placed in the funnel, a standard stopwatch is started. When approximately 25 grams of liquid collects into the calibrated beaker, the time is stopped and recorded. This recorded time is the foam half-life.

In some instances, the average cell size, wall thickness, and/or density may also foster the stability of the foam. For instance, the foam may have a size, thickness, or density such as described in U.S. Pat. No. 4,099,913 issued to Walter, et al. and U.S. Pat. No. 5,985,434 issued to Qin, et al., which are both incorporated herein in their entirety by reference thereto for all purposes. For example, in one embodiment, the average cell size of the foam cell may be from about 10 microns to about 100 microns. Moreover, the average wall thickness of the foam cell may be from about 0.1 micron to about 30 microns.

After generation, the foam is then forced out of the foam generator, where it may travel via one or more conduits to the foam applicator 40. The diameter of the conduits, the length of the conduits, the pressure of the foam bubbles after exiting the foam generator, and the like, may all be controlled to vary the nature of foam application. For instance, in one embodiment, a conduit having an inner diameter from about 0.375 inches to about 1.5 inches may be utilized to process from about 10 to about 3000 cubic centimeters of air per minute, such as from about 300 to about 3000 cubic centimeters of air per minute and about 20 to about 300 grams of liquid per minute. Moreover, in one embodiment, the length of the conduit may be about 50 feet in length. In addition, upon exiting the foam generator, the pressure of the foam bubbles may be from about 5 psi to about 90 psi, and more particularly from about 30 psi to about 60 psi.

In accordance with the present invention, a foam applicator may be positioned at one or more locations of the papermaking machine to apply the foam to the paper web. In particular, regardless of the papermaking process utilized, the foam applicator is positioned so that a foam composition is applied to a moving papermaking surface (e.g., fabric). Thereafter, the moving papermaking surface is brought into contact with another moving papermaking surface on which a paper web optionally resides. As a result, the paper web and foam composition are brought into contact with each other and are positioned between the two papermaking surfaces. Typically, the papermaking surfaces are impressed together to facilitate transfer of the foam composition to the paper web.

Referring again to FIGS. 1–2, one embodiment of the present invention for applying a foam composition during a papermaking is illustrated. The foam applicator 40 of the illustrated embodiment first deposits the foam composition onto the fabric 23, which is moving toward the fabric 19 as indicated by the directional arrow shown in FIG. 2.

Figure 3:
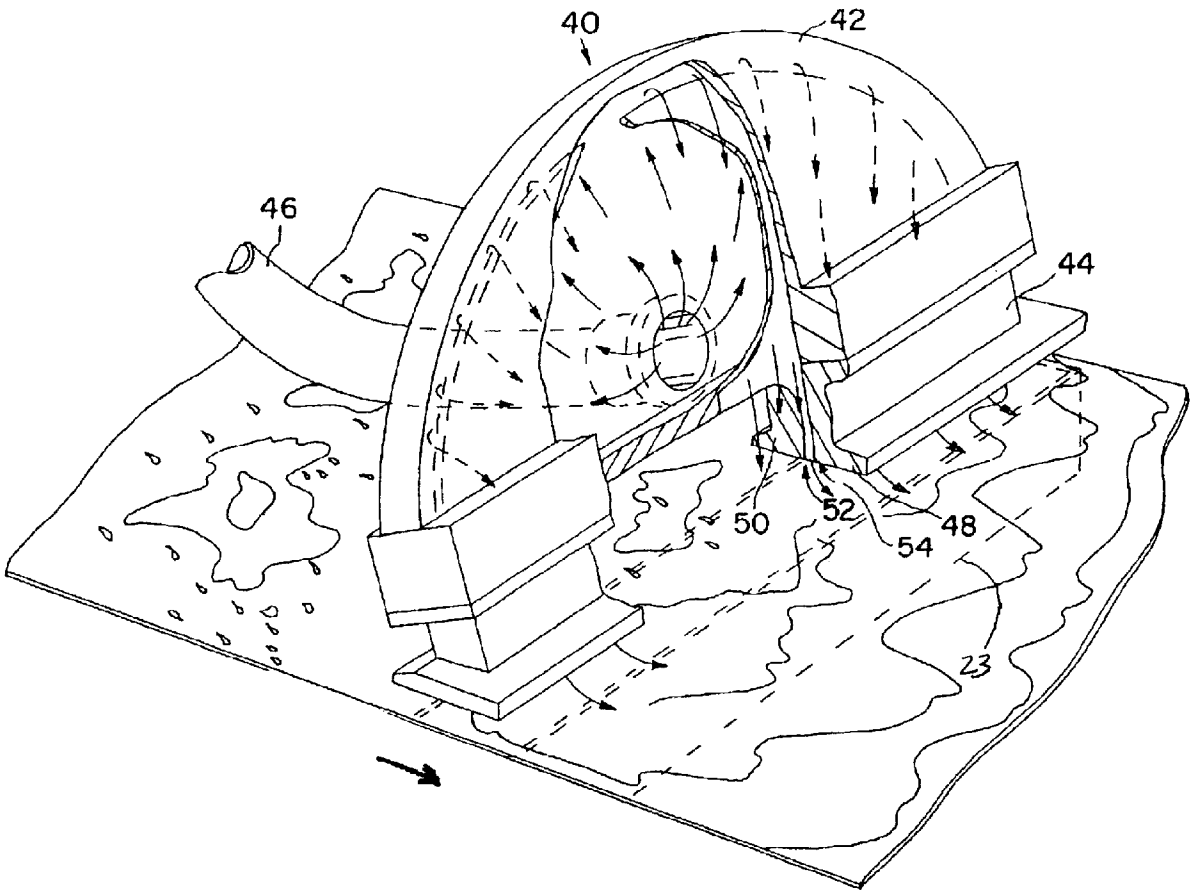
FIG. 3 is a perspective view of a foam applicator that may be used in one embodiment of the present invention.

In general, any foam applicator that is capable of applying a foam composition, such as described above, onto a papermaking surface may be used in the present invention. Referring to FIG. 3, for instance, one embodiment of a foam applicator 40 that includes a distribution chamber 42 and an extrusion head 44 is illustrated. The distribution chamber 42 may generally have any desired shape, size, and/or dimension. For instance, the distribution chamber 42 shown in FIG. 3 has a parabolic shape. Other examples of suitable distribution chambers are described in the Clifford et al. reference. Moreover, it should also be understood that any method or apparatus for applying a foam to a papermaking surface may be used in the present invention, and that the foam applicator 40 depicted and described herein is for illustrative purposes only.

As the foam enters the distribution chamber 42 from a conduit 46, it is initially forced upward to assure that any decaying foam collects therein for automatic draining. Thereafter, it flows downward through the distribution chamber 42 to the extrusion head 44. Extrusion heads having any of a variety of shapes and sizes may be used in the present invention. In one embodiment of the present invention, a "straight slot" extrusion head, such as described in the Clifford, et al. reference and the Cunningham, et al. reference, is utilized. As used herein, the straight slot extrusion head generally refers to an extrusion head generally 44 having parallel nozzle bars 48 and 50. In one embodiment, the extrusion head 44 includes two parallel nozzle bars, a first nozzle bar 48 and a second nozzle bar 50, that form an dispensing slot 52 which generally has a width of from about 0.025 inches to about 0.5625 inches in the −x direction (machine direction), and in some embodiments, from about 0.050 inches to about 0.0626 inches in the −x direction. For instance, in one embodiment, the width of the dispensing slot 52 is about 0.13 inches. In another embodiment, the width of the dispensing slot 52 is about 0.05 inches. Moreover, the length of the dispensing slot 52 can vary depending on the dimensions of the web. For instance, in some embodiments, the dispensing slot 52 has a length from about 0.125 inches to about 300 inches in the −z direction (cross direction). The length of the dispensing slot 52 in the −z direction, however, may be varied as desired to adjust the paper web handling land area. For example, in some embodiments, the length of the dispensing slot 52 in the –z direction is from about 100 inches to about 200 inches.

To facilitate uniform and stable deposition of the foam composition onto the fabric 23, it is often desired that one or more of the nozzle bars 48 and/or 50 contact the fabric 23 during foam deposition. For instance, in the illustrated embodiment, the nozzle bar 50 remains substantially in contact with the fabric 23 during foam deposition, while the nozzle bar 48 is positioned a certain distance from the fabric 23. By contacting the fabric 23 during deposition, it is believed that the nozzle bar 50 can render the fabric 23 more stable to facilitate foam deposition thereon. Moreover, the nozzle bar 48 remains above the fabric 23 to allow deposition of the foam thereon. If desired, the nozzle bar 48 can be moveable so that its perpendicular distance from the fabric 23 can be increased or decreased. When positioned at relatively large distances from the fabric 23, the foam may tend to "mushroom" out, thereby inhibiting the formation of a uniform foam layer. Likewise, when positioned at relatively small distances from the fabric 23, the nozzle bar 48 can actually inhibit deposition of the foam. Thus, in some embodiments, it is desired that the nozzle bar 48 be positioned from about 0.001 inches to about 1 inch from the fabric 23, in some embodiments from about 0.01 inches to about 0.25 inches from the fabric 23, and in some embodiments, from about 0.01 inches to about 0.125 inches.

In addition, other devices and/or techniques may also be utilized to enhance the uniformity of foam deposition. For instance, in some embodiments, metering blades, which are well known in the art, may be used to apply a controlled amount of foam to the fabric 23 over a certain period of time.

Referring again to FIGS. 1–2, once applied to the moving fabric 23, the foam composition is then placed into contact with the wet paper web 15, which is carried by the through-drying fabric 19 and moving in a direction indicated by the directional arrow shown in FIG. 2. In this embodiment, the solids consistency of the wet paper web 15 being applied with foam is less than about 95% by dry weight of the wet paper web 15, in some embodiments from about 60% to about 95% by dry weight of the wet paper web 15, and in some embodiments, from about 80% to about 90% by dry weight of the wet paper web 15.

Because the fabrics 19 and 23 are generally kept under tension during foam deposition and throughout the papermaking process, the wet paper web 15 and foam composition become impressed between the fabrics 19 and 23, thereby causing the foam composition to transfer from the fabric 23 to the paper web 15. To facilitate this transfer, various aspects of the papermaking process can be selectively controlled. For instance, in some embodiments, such as shown in FIG. 3, the angle that the fabric 19 is wrapped around the roll 71, i.e., the "wrap angle", can be varied to alter the amount of time in which the wet paper web 15 remains in contact with the foam composition. Higher wrap angles generally result in a longer contact time, and thus enhance transfer of the foam composition to the wet paper web 15. Likewise, lower wrap angles generally result in a shorter contact time. Typically, the wrap angle is from about 90° to about 180°, and in some embodiments, from about 100° to about 150°. In one particular embodiment, the wrap angle is about 130°.

Figure 2:
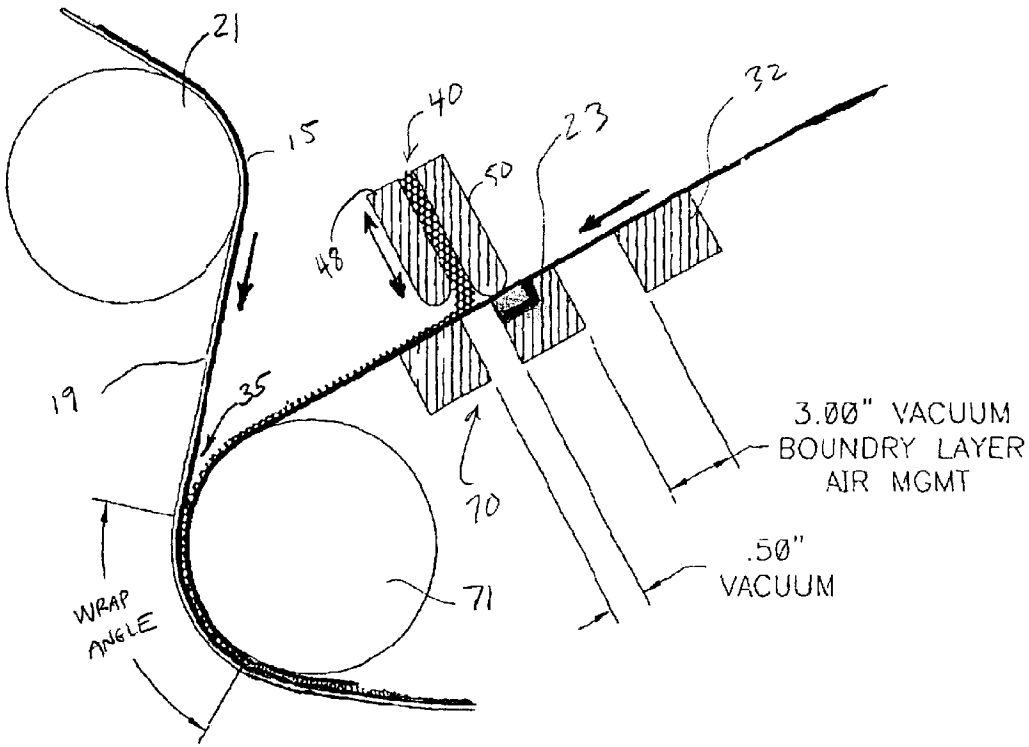
FIG. 2 is a schematic illustration of one embodiment of the present invention for applying a foam composition to a paper web.

The distance of the foam applicator 40 from a nip, such as the nip 35 shown in FIGS. 1–2, may also be varied. For example, in some embodiments, the foam applicator 40 may be positioned less than about 200 inches from the nip 35, in some embodiments less than about 100 inches from the nip 35, and in some embodiments, from about 5 inches to about 60 inches from a nip 35. Although not limited in theory, applying the foam composition at a location that is relatively close to the nip 35 may facilitate the application of foam to the wet paper web 15. In particular, the motion of the two fabrics 19 and 23 forming the nip 35 may allow the boundary air layers to facilitate transfer of the foam composition from the fabric 23 to the wet paper web 15.

In addition, various other devices and/or techniques may also be utilized to facilitate transfer of the foam composition to the wet paper web 15. For instance, in some embodiments, positive and/or negative air pressure may be applied to the wet paper web 15 while sandwiched between the fabrics 19 and 23. Air pressure may facilitate the transfer of any foam remaining on the fabric 23 to the wet paper web 15. Some suitable examples of air pressure devices (positive and/or negative) include, but are not limited to, air knives, vacuum boxes, vacuum shoes, vacuum rolls, foils, or any other method known in the art.

Moreover, to aid in the application of foam to the fabric 23, a vacuum slot 70 may be positioned to extend across the width of the fabric 23 in the cross direction of the fabric 23 below the foam applicator 40. It is understood that the vacuum slot 70 may be one continuous vacuum slot or made up of multiple vacuum slots positioned across the CD direction of the fabric 23. The vacuum slot 70 may generally be formed by a variety of devices that are capable of applying a negative pressure on the fabric 23, such as vacuum boxes, vacuum shoes, vacuum rolls, foils, or any other method known in the art. The vacuum slot 70 may have a slot opening width from about 1 inch and about ⅛ inch, more specifically a width from about ¾ inch and about ¼ inch, and most specifically a width from about ¾ inch and about ½ inch. For instance, in one embodiment, the vacuum slot 70 has a slot opening width of about ½ inch to about ¾ inch and operates at a vacuum pressure of from about 20 to about 25 inches of water.

Although not required, the vacuum slot 70 may aid in drawing the foam toward and onto the fabric 23. For instance, once formed, the foam bubbles generally remain under pressure until the instant of application to the fabric 23 by the foam applicator 40 so that the liquid forming the bubbles may be blown onto the fabric 23 by airlet(s) and/or nozzle(s) of the foam applicator 40. The vacuum slot 70 may draw these foam bubbles towards the fabric 23, thereby facilitating the application of the foam onto the fabric 23. The vacuum slot 70 may also be utilized to reduce the boundary air layer surrounding the paper web 15. In addition, the vacuum slot 70 assists with the deposition of the foam onto the paper web 15. The vacuum slot 70 also aids in the removal of the air that is entrained within the foam. It should be understood that other vacuum slot(s) located in various positions may be utilized in the present invention. Moreover, it should also be understood that a vacuum slot is not required to apply foam to the fabric. For example, in some embodiments, the fabric may be substantially impermeable so that a vacuum slot is not desirable.

Further, in some embodiments, a boundary air layer vacuum slot 32 may be utilized to reduce the "boundary air layer" surrounding the fabric 23. As used herein, a "boundary air layer" generally refers to a layer of air that is entrained by a moving fabric or paper web supported on a fabric. Boundary air layers may be present at any speed at which a tissue machine is operated, including speeds of about 1,000 feet per minute, about 2,000 feet per minute, and 3,000 feet per minute or greater. For example, boundary air layers often occur at high linear speeds, such as at speeds above about 4,000 feet per minute, and in some embodiments, from about 4,000 feet per minute to about 6,000 feet per minute. Boundary air layers may sometimes disrupt foam application. As such, it is typically desired to minimize the boundary air layer to enhance the efficiency of foam application. In one embodiment, for example, the boundary air layer vacuum slot 32 may be downstream from the foam applicator 40 to help minimize the boundary air layer.

The boundary air layer vacuum slot 32 may be positioned to extend across the width of the fabric 23. The length of the boundary air layer vacuum slot 32 can be from about 0.25 inches and about 6 inches, and in some embodiments, from about 1 inch to about 5 inches. For instance, in one embodiment, the length of the boundary air layer vacuum slot 32 is about 3 inches and the vacuum pressure was approximately 1 psig or less.

The boundary air layer vacuum slot 32 may generally be formed by a variety of devices that are capable of applying a negative pressure on the fabric 23, such as vacuum boxes, vacuum shoes, vacuum rolls, foils, or any other method known in the art. Moreover, the boundary air layer vacuum slot 32 may have any desired size, dimension, and/or shape desired. For example, in some embodiments, the boundary air layer vacuum slot 32 may have a slot opening width from about 3 inches and about ⅛ inch, more specifically a width from about ¾ inch and about ¼ inch, and most specifically a width from about ¾ inch and about ½ inch. For instance, in one embodiment, the boundary air layer vacuum slot 32 has a slot opening width of about 3 inches.

Various other mechanisms may also be utilized to minimize the boundary air layer, such as using deflecting mechanisms. Moreover, it should be understood that it may not be necessary to reduce the boundary air layer in all circumstances when applying a foam to a wet paper web 15 in accordance with the present invention.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A method of applying a foam composition to a paper web having a first surface and an opposing second surface, said method comprising:

forming a paper web from papermaking fibers, wherein the paper web is carried by a first moving papermaking surface so that the first surface of the paper web faces said first moving papermaking surface;

depositing the foam composition onto a second moving papermaking surface, said second moving papermaking surface comprising a foraminous surface; and positioning said first moving papermaking surface adjacent to said second moving papermaking surface so that the second surface of the paper web faces said second moving papermaking surface, wherein at least a portion of the foam composition is transferred to the paper web.

2. A method as defined in claim 1, wherein said first moving papermaking surface and said second moving papermaking surface are fabrics.

3. A method as defined in claim 1, wherein said first moving papermaking surface and said second moving pap&making surface are wrapped around a roll.

4. A method as defined in claim 3, wherein said first and second moving papermaking surfaces are impressed against said roll.

5. A method as defined in claim 3, wherein the angle of said wrap is from about 90° to about 180°.

6. A method as defined in claim 3, wherein the angle of said wrap is from about 100° to about 150°.

7. A method as defined in claim 1, wherein said first moving papermaking surface and said second moving papermaking surface converge at a nip with the paper web positioned therebetween.

8. A method as defined in claim 7, wherein the foam composition is applied to said second moving papermaking surface using a foam applicator that is positioned less than about 100 inches from said nip.

9. A method as defined in claim 7, wherein the foam composition is applied to said second moving papermaking surface using a foam applicator that is positioned from about 5 inches to about 60 inches from said nip.

10. A method as defined in claim 1, wherein the foam composition is applied to said second moving papermaking surface using a foam applicator that comprises first and second nozzle bars.

11. A method as defined in claim 10, wherein at least one of said nozzle bars contacts said second moving papermaking surface during application of the foam composition.

12. A method as defined in claim 10, wherein at least one of said nozzle bars is positioned from about 0.01 inches to about 0.25 inches from said second moving papermaking surface during application of the foam composition.

13. A method as defined in claim 1, further comprising drawing the foam composition onto said second moving papermaking surface through the use of a vacuum slot.

14. A method as defined in claim 1, wherein the paper web is formed by an uncreped through-drying process.

15. A method as defined in claim 1, wherein the paper web is a wet paper web.

16. A method as defined in claim 1, wherein the paper web is a dried paper web.

17. A method of applying a foam composition to a paper web having a first surface and an opposing second surface, said method comprising:

forming a paper web from papermaking fibers, wherein the paper web is carried by a first moving fabric so that the first surface of the paper web faces said first moving fabric;

depositing the foam composition onto a second moving fabric using a foam applicator;

wrapping said first moving fabric and said second moving fabric around a roll so that said first moving fabric is placed adjacent to said second moving fabric, wherein the second surface of the paper web faces said second moving fabric; and impressing said first and second moving fabrics against the roll, wherein at least a portion of the foam composition is transferred to the paper web.

18. A method as defined in claim 17, wherein the angle of said wrap is from about 90° to about 180°.

19. A method as defined in claim 17, wherein the angle of said wrap is from about 100° to about 150°.

20. A method as defined in claim 17, wherein said first moving fabric and said second moving fabric converge at a nip with the paper web positioned therebetween.

21. A method as defined in claim 17, wherein said foam applicator comprises first and second nozzle bars.

22. A method as defined in claim 21, wherein at least one of said nozzle bars contacts said second moving papermaking surface during application of the foam composition.

23. A method as defined in claim 21, wherein at least one of said nozzle bars is positioned from about 0.01 inches to about 0.25 inches from said second moving papermaking surface during application of the foam composition.

24. A method as defined in claim 17, further comprising drawing the foam composition onto said second moving fabric through the use of a vacuum slot.

25. A method as defined in claim 17, wherein the paper web is formed by an uncreped through-drying process.

26. A method of applying a foam composition to a paper web having a first surface and an opposing second surface, said method comprising:

depositing an aqueous suspension of papermaking fibers onto a forming surface to form a paper web;

transferring said paper web to a first moving papermaking surface, wherein the first surface of the paper web faces said first moving papermaking surface;

depositing the foam composition onto a second moving papermaking surface using a foam applicator;

wrapping said first moving papermaking surface and said second moving papermaking surface around a roll so that said first moving papermaking surface is placed adjacent to said second moving papermaking surface, wherein the second surface of the paper web faces said second moving papermaking surface;

impressing said first and second moving papermaking surfaces against the roll, wherein at least a portion of the foam composition is transferred to the paper web; and drying the paper web with a through-dryer.

27. A method as defined in claim 26, wherein said first moving papermaking surface and said second moving papermaking surface are fabrics.

28. A method as defined in claim 26, wherein said first moving papermaking surface and said second moving papermaking surface converge at a nip with the paper web positioned therebetween.

29. A method as defined in claim 26, wherein said foam applicator comprises first and second nozzle bars.

30. A method as defined in claim 29, wherein at least one of said nozzle bars contacts said second moving papermaking surface during application of the foam composition.

31. A method as defined in claim 29, wherein at least one of said nozzle bars is positioned from about 0.01 inches to about 0.25 inches from said second moving papermaking surface during application of the foam composition.

32. A method as defined in claim 26, further comprising drawing the foam composition onto said second moving papermaking surface through the use of a vacuum slot.

* * * * *